United States Patent [19]

Ohtagaki et al.

[11] Patent Number: 4,567,403

[45] Date of Patent: Jan. 28, 1986

[54] HIGH PRESSURE DISCHARGE LAMP WITH INCORPORATED STARTER

[75] Inventors: Yoshio Ohtagaki, Gyoda; Masafumi Ochi, Kounosu; Motonobu Masui, Kumagaya; Kanichi Tachibana, Saitama; Akio Uchida, Yokose, all of Japan

[73] Assignees: Iwasaki Electric Co., Ltd.; Mitsubishi Mining & Cement Company, Ltd., both of Tokyo, Japan

[21] Appl. No.: 349,969

[22] Filed: Feb. 18, 1982

[51] Int. Cl.[4] ..... H01J 7/44; H01J 17/34; H01J 19/78; H01J 29/96

[52] U.S. Cl. ..... 315/47; 361/118; 315/46; 315/73; 315/74; 315/289; 315/290

[58] Field of Search ..... 315/46, 47, 48, 60, 315/73, 74, 289, 290, 104; 361/118

[56] References Cited

U.S. PATENT DOCUMENTS

| | | | |
|---|---|---|---|
| 2,570,780 | 10/1951 | Duckett et al. | 315/290 |
| 3,740,686 | 6/1973 | Jarrige et al. | 361/118 |
| 3,889,222 | 6/1975 | Takano et al. | 361/118 |
| 4,064,416 | 12/1977 | Krense et al. | 315/60 |
| 4,135,114 | 1/1979 | Narikiyo | 315/73 |
| 4,137,483 | 1/1979 | Ochi et al. | 315/74 |
| 4,206,385 | 6/1980 | Wisbey | 315/119 |
| 4,316,122 | 2/1982 | Yamazaki et al. | 315/74 |
| 4,322,658 | 3/1982 | Minarczyk | 315/74 |
| 4,379,982 | 4/1983 | Proud | 315/74 |
| 4,400,754 | 8/1983 | Schweickardt | 361/118 |

FOREIGN PATENT DOCUMENTS

| | | | |
|---|---|---|---|
| 54-155673 | 12/1979 | Japan | 315/73 |
| 56-4198 | 1/1981 | Japan | 315/73 |
| 56-57249 | 5/1981 | Japan | 315/47 |
| 56-167256 | 12/1981 | Japan | 315/73 |

*Primary Examiner*—Saxfield Chatmon
*Attorney, Agent, or Firm*—Shapiro and Shapiro

[57] ABSTRACT

In a high pressure discharge lamp device provided with an inductive stabilizer and a starting circuit consisting of a serial circuit of a resistor and a bimetal switch, a pulse waveform conversion circuit is arranged therein to reduce the pulse peak of the starting voltage and also broaden the pulse width of the starting voltage. The pulse waveform conversion circuit comprises a serial circuit of a resistor and a switching element, such as micro-gap element, which operates at a voltage lower than the starting voltage of the discharge lamp but higher than the secondary load-free voltage of the stabilizer.

10 Claims, 15 Drawing Figures

HIGH PRESSURE DISCHARGE LAMP WITH INCORPORATED STARTER

BACKGROUND OF THE INVENTION

1. Field of the Invention

The present invention relates to an improvement in a starter for starting a high pressure discharge lamp such as a high pressure sodium lamp.

2. Description of the Prior Art

In order to facilitate the starting of a high pressure discharge lamp such as the high pressure sodium lamp that has a high starting voltage and that is difficult to start with the ordinary commercial line voltage, there is already known a starting circuit consisting of a serial connection of a resistor, for example an incandescent filament, and a bimetal switch, and connected parallel to an arc tube of the high pressure discharge lamp which is connected to an AC power source through an inductive stabilizer such as a choke coil. The high pressure discharge lamp incorporating such starting circuit together with the arc tube in an outer bulb is becoming rapidly popular, since such lamp can be used in combination with the existing stabilizer without the use of an independent starting device.

The function of such starting circuit, as already disclosed in the Japanese patent application Laid-Open No. 51-67174, will be briefly explained in the following in order to facilitate the understanding of the present invention.

Referring to FIG. 1, upon start of power supply from an AC power source 2, a current supplied through a stabilizer 1 to a starting circuit 6 heats a bimetal switch 5, thus opening said switch. The sudden current interruption by the opening of said bimetal switch 5 induces a high pulse voltage in the stabilizer 1 by the inverse electromotive force. With the heating current being cut off by said opening, the bimetal switch 5 is subsequently closed again to repeat the above-mentioned procedure. The pulses of an appropriate number thus generated by the repeated opening and closing of the bimetal switch 5 are applied to an arc tube 3 together with the power supply voltage to start the high pressure discharge lamp. As the operation of the discharge lamp becomes stabilized after its start, the arc tube increases the radiating heat to maintain said bimetal switch 5 in the open state. In the above-explained circuit, a current-limiting resistor 4 is inserted in the starting circuit 6 for the following purposes.

Firstly, without said resistor 4, the current in the starting circuit 6 will become as almost large as the shortcircuiting current of the stabilizer 1 to induce an extremely high pulse voltage exceeding several kilovolts when the bimetal switch 5 is opened, thus destroying the insulation of the stabilizer or other circuits.

Secondly, even if the discharge in the arc tube is successfully induced by one of plural pulse voltages generated by the repeated opening and closing of the bimetal switch 5, the discharge will be extinguished by the diversion of the discharge current to the starting circuit upon re-closing of the bimetal switch 5 if said resistor is not present in the starting circuit.

Thus, in such known circuit, the resistor 4 in the starting circuit 6 is appropriately selected so as to regulate the pulse voltage and to prevent the undesirable extinguishing of the arc tube.

Such known starting system is, however, unstable when powered by a commercial AC power supply because of the fluctuation in the instantaneous current at the opening of the bimetal switch, in the opening speed thereof and in the arc state between the contacts of the bimetal switch. As an example, FIG. 2 shows the distribution of peak pulse voltages obtained in 150 repeated operations of the bimetal switch 5 in a circuit shown in FIG. 1, employing an AC power source 2 of 200 V; a stabilizer choke coil 1 of ca. 120 mH; a high pressure sodium arc tube 3 of 360 W; and an incandescent filament resistor 4 with an operating resistance of ca. 200 Ω. As shown in FIG. 2, the pulse voltages show considerable fluctuation ranging from ca. 1 KV to ca. 5 KV. In such known system, a certain fluctuation in the pulse voltage is unavoidable in order to ensure satisfactory starting performance, thus leading occasionally to the appearance of a very high pulse voltage. Although such high pulse voltage can be avoided by an appropriate adjustment of the resistance of said resistor 4 in the starting circuit 6 to displace said voltage distribution toward a lower value, such adjustment will inevitably lower the starting probability of the discharge lamp. Stated otherwise, such known system is inevitably associated with the appearance of unnecessarily high pulse voltages in order to maintain a certain desired level of starting probability, and various methods have been proposed to eliminate such pulse voltages.

As an example, the Japanese patent ppplication Laid-Open No. 53-103668 proposes, for absorbing unnecessarily high pulse voltage, to connect a pulse-absorbing discharge tube starting at a voltage higher than the starting voltage of the arc tube, parallel to said arc tube or to the bimetal switch in the starting circuit. In practice, however, it is difficult to find an appropriate discharge tube capable of absorbing the pulse voltage in response to a pulse width as short as ca. 1 μsec. generated by the function of the bimetal switch in the starting circuit, and such method is found to be unable to resolve the unstable function resulting from the fluctuation of the pulse voltage. As a method for eliminating the fluctuation in the pulse voltage, the Japanese patent application Laid-Open No. 55-143771 proposes to enclose a gas for reducing the pulse voltage generated by the function of the bimetal switch 5 in the outer bulb 7 incorporating the starting circuit 6 shown in FIG. 1. This method is to suppress the generation of unnecessarily high voltages, and it is confirmed that the generated pulse voltage, with reduced high frequency components and increased pulse duration, exhibits stable starting performance despite the generally reduced peak voltage. However such method is still defective in that a predetermined amount of gas has to be enclosed in the outer bulb during manufacture, and in that it is difficult to maintain stable performance as gaseous impurities are emitted from the arc tube and the support structure thereof during use.

SUMMARY OF THE INVENTION

The object of the present invention, reached through detailed examination of the relationship between the starting condition of high pressure discharge lamps and the wave form of the pulse voltage, is to provide a starter capable of generating pulse voltages not having excessively high peak values without degrading the starting performance of the discharge lamp, thereby ensuring rapid and stable start thereof.

The above-mentioned object can be achieved according to the present invention in the following manner. As will be apparent from FIG. 3 showing the relationship between the breakdown or starting voltage of a 360 W high pressure sodium lamp and the half-peak width of the applied pulse voltage, the lamp requires a higher starting voltage at a smaller pulse width. Conversely, the use of a larger pulse width allows starting the discharge lamp with a lower pulse voltage, thus alleviating the effect of higher pulse voltage on the stabilizer and the related circuitry. In the conventional starter as explained in the foregoing, the generated voltage is composed, as shown in FIG. 4, principally of sawtooth-shaped pulses (A) with short durations and with relatively high absolute values, followed by sinusoidal pulses (B) with a broader form. Said sawtooth pulses (A) can only start the discharge lamp at 4–5 KV or higher due to the limited duration thereof as short as 2 μsec. or less, and often remain unabsorbed even after the start of the discharge lamp. In this manner the conventional starter is inevitably associated with high pulse voltages. On the other hand the present invention provides a novel starter capable of waveform conversion for suppressing the above-mentioned sawtooth pulses, reducing the pulse peak voltages and broadening the pulse duration, thereby ensuring easy and stable start of the discharge lamp.

DESCRIPTION OF THE PREFERRED EMBODIMENTS

Figure 5:
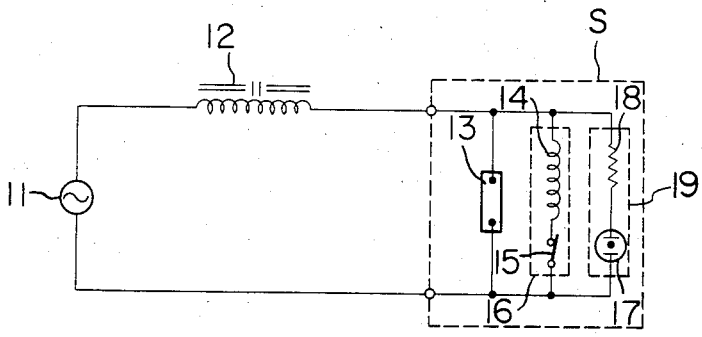
FIG. 5 is a circuit diagram of a starter embodying the present invention.

Now reference is made to FIG. 5 showing an embodiment of the starter of the present invention for a high pressure discharge lamp, wherein an AC power source 11, a stabilizer 12 and an arc tube 13 of the high pressure discharge lamp are serially connected to constitute a discharge holding circuit of said discharge lamp. A resistor 14, such as an incandescent filament, and a bimetal switch 15 constitute a serial starting circuit 16 connected parallel to said arc tube 13. According to the present invention, the starter explained above is further provided, parallel to said arc tube 13, with a pulse waveform conversion circuit 19 composed of a resistor 18 and a micro-gap element 17 which functions as switching means which operates at a voltage lower than the starting voltage of the discharge lamp but higher than the secondary load-free voltage of the stabilizer and is responsive to high-frequency pulses.

Figure 6:
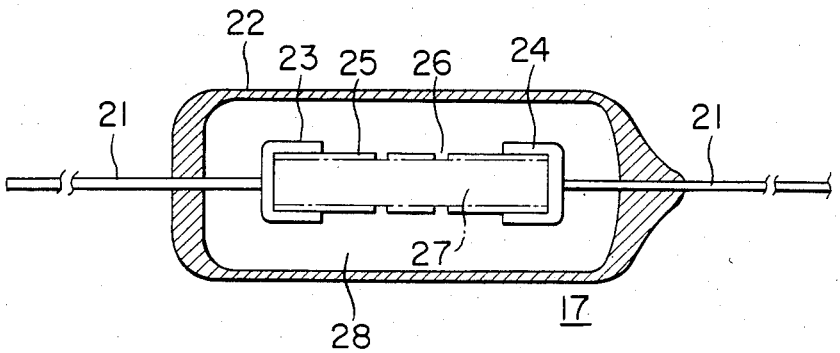
FIG. 6 is a cross-sectional view showing a pulse-controlling micro-gap element.

The structure and the function of the above-mentioned micro-gap element will be explained in the following. As already disclosed for example in the Japanese patent applications Laid-Open Nos. 51-97740, 52-6956 and 55-128283, said micro-gap element 17 has a basic structure shown in FIG. 6, wherein an insulating rod 27 of a material having a relative dielectric constant larger than 1 such as mullite, forstelite, alumina or steatite, is surfacially provided with an electroconductive ceramic layer 25 for example of $SnO_2$, $Nb_2O_3$, $MoO_3$ or $WO_2$ divided into plural zones by annular gaps of a width not exceeding 200 μm. The end zones of thus divided conductive ceramic layer 25 are equipped with metal caps 23, 24 for constituting electrodes. The above-mentioned structure is housed in an airtight container 22 filled with a rare or inert gas, and metal lead wires 21 connected to said metal caps are guided to the exterior through said container. Upon application of a surge voltage between the electrodes of such micro-gap element, the generated electric field is at first concentrated in the gaps 26 of the conductive ceramic layer 25, thus generating primary discharge in said gaps. The electrons released by said primary discharge collide with the surrounding gas to cause ionization thereof, and the new electrons released at said ionization further ionize said gas. Said ionization of gas proceeds rapidly by the repetition of the above-mentioned phenomenon to eventually cause insulation breakdown of the gas, thus initiating a secondary gas discharge between the electrodes. Said secondary discharge is extremely rapid, with little delay in time. Said secondary gas discharge shifts from glow discharge to arc discharge with the increase of surge current, but is principally composed of a surfacial discharge along the conductive ceramic layer. Said surfacial discharge, particularly marked in the initial phase of the secondary gas discharge, further accelerates said secondary discharge, thus reducing the delay of the discharge. The above-explained micro-gap element based on two-step discharge are characterized in having a smaller dimension, for example 6 mm in diameter and 21 mm in length for a starting voltage of 3 KV in comparison with varistor or similar conventional elements, showing an extremely stable performance even in a high-temperature situation exceeding 100° C., and being capable of effectively responding to rapid voltage pulses by the shorter delay in discharge than in the conventional discharge gaps. Furthermore it shows a satisfactory interrupting performance against the continued flow of electric current through the micro-gap element from the power source after the start of discharge in said element, a stable discharge starting voltage, absence of shortcircuit state after the insulation breakdown and a small limiting voltage.

Figure 7:
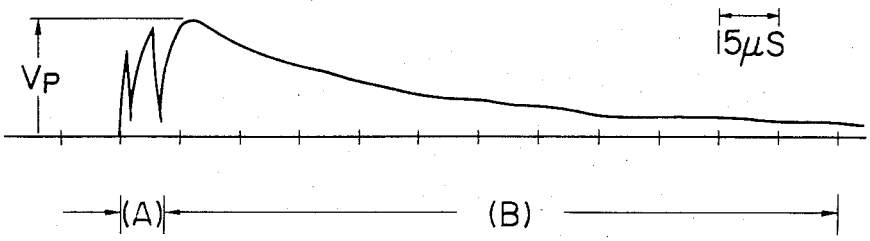
FIG. 7 is a waveform chart showing pulse voltages generated by the starter of the present invention shown in FIG. 5.

The serial circuit of such micro-gap element 17 and a resistor 18, connected parallel to the arc tube 13 and the starting circuit 16, results in pulse voltages as shown in FIG. 7, in which the sawtooth part (A) is significantly decreased and the sinusoidal part (B) is transformed to a waveform of damped oscillation with a broadened duration, whereby the pulse energy can be more effectively utilized in the starting of the discharge lamp although the peak voltage $V_p$ is reduced. The broadening of the pulse duration is attributable to a change from the oscillating condition to the damping condition caused by the increase in the resistance component in the equivalent LCR circuit in the stabilizer, and the decrease of the sawtooth part is presumably attributable to the reduced discharge between the contact of the bimetal switch at the opening thereof, since the peak pulse voltage is reduced by the presence of said resistor 18.

Figure 3:
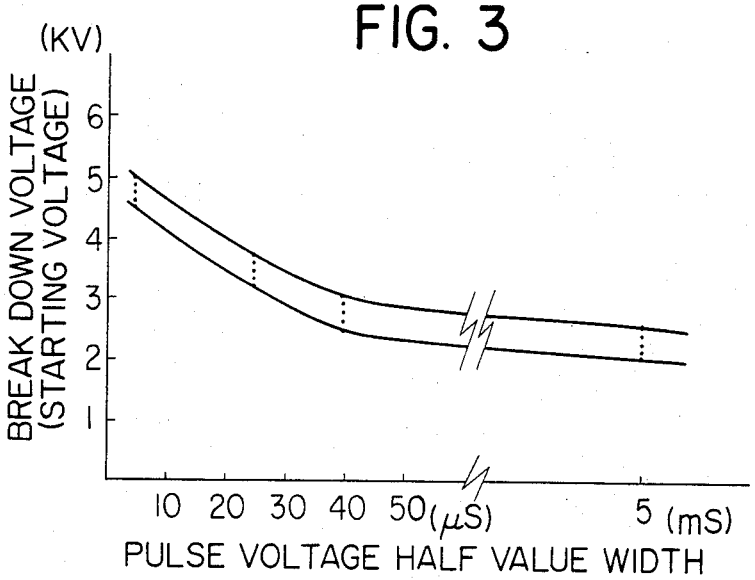
FIG. 3 is a chart showing the relationship between the starting voltage for the discharge lamp and the half-peak width of the pulse voltage in the starter shown in FIG. 1.
Figure 4:
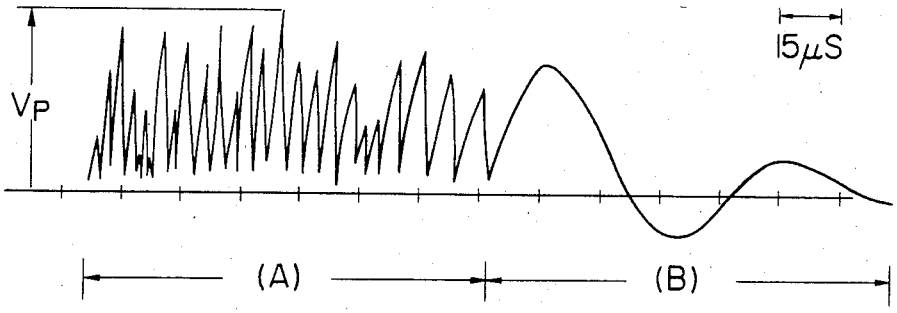
FIG. 4 is a waveform chart showing pulse voltages generated in a conventional starter.
Figure 8:
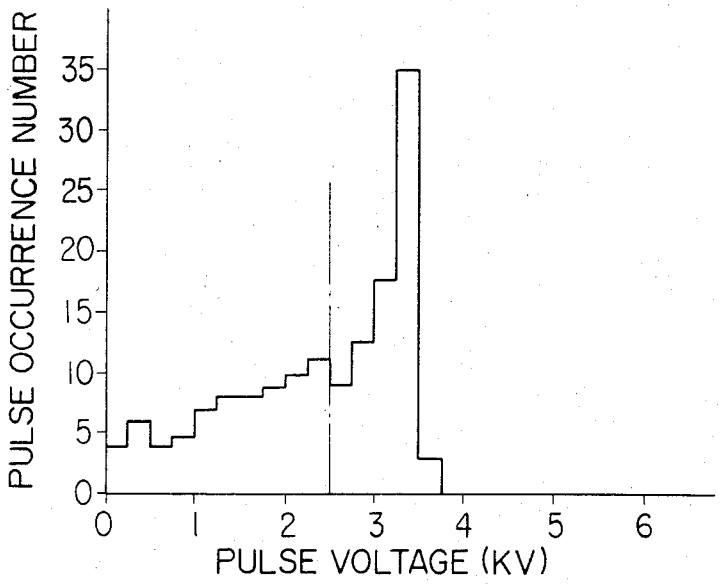
FIG. 8 is a chart showing the distribution of peak pulse voltages generated by the starter of the present invention shown in FIG. 5.

Due to the reduced peak pulse voltage and the absence of uncontrollable discharge process in the contacts of the bimetal switch, the starter of the present invention is capable of significantly reducing the fluctuation in the height and form of the pulse voltages. As will be apparent from FIG. 8 showing the distribution of the peak pulse voltages, unnecessarily high pulse voltages in the range of 4 to 5 KV are entirely absent. Consequently the safety for the stabilizer and the related circuitry is remarkably improved, and the starting performance is still ensured by the broadened pulse duration. As already explained in relation to FIG. 3 showing the relationship between the starting voltage and the half-peak width of applied pulse voltage in a 360 W high pressure sodium lamp, the starting of the lamp is facilitated by a larger pulse duration.

The resistance of the resistor 18 in the circuit 19 is determined in consideration of the distribution of the peak pulse voltages and the starting characteristic of the discharge lamp. A larger resistance leads to an oscillating pulse form with increased high-frequency components, a higher pulse peak and a narrower pulse duration, and vice versa. In starting a high pressure sodium lamp of 180–980 W with an AC commercial power supply of 200 V through a stabilizer choke coil of 50–500 mH, said resistance is selected within a range from 1 to 10 kΩ.

Figure 1:
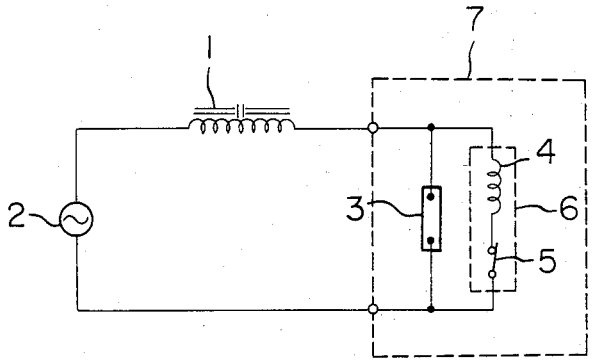
FIG. 1 (PRIOR ART)
FIG. 1 is a circuit diagram of a conventional starter for a high pressure discharge lamp.
Figure 2:
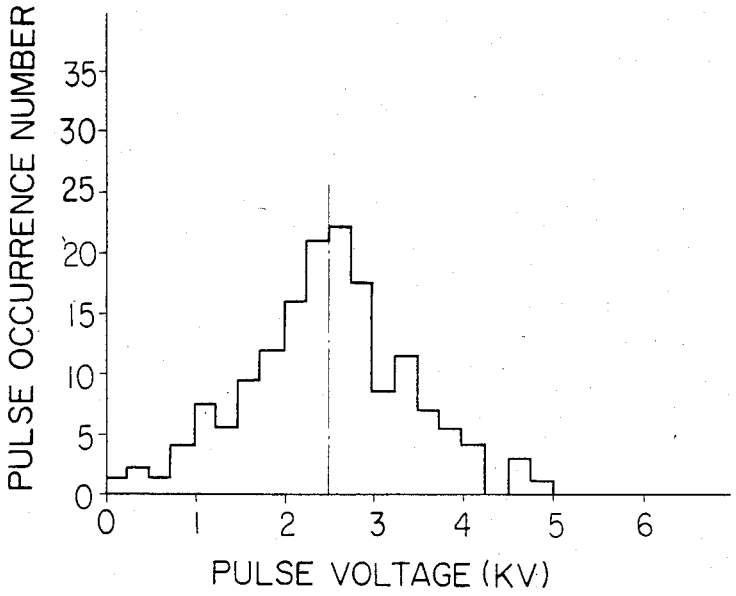
FIG. 2 is a chart showing the distribution of peak pulse voltages in the starter shown in FIG. 1.

The performance of the starter of the present invention will also be understood from the comparison of FIGS. 2 and 8. Assuming that the discharge lamp can be started at 2.5 KV, the probability of obtaining a pulse exceeding 2.5 KV in the conventional starter is 0.5 as determined in FIG. 2 by the ratio of the number of pulse exceeding 2.5 KV to that of the entire number of pulses. Said probability is also 0.5 in the starter of the present invention. However the maximum pulse voltage is 3.8 KV in the latter whereas it is 5 KV in the former. Stated differently, the starter of the present invention is capable of reducing the maximum pulse voltage for a given starting performance, or of improving the starting performance for a given maximum pulse voltage.

As explained in the foregoing, the present invention is characterized by the presence of a micro-gap element 17, functioning at a voltage lower than the starting voltage of the discharge lamp but higher than the secondary loadfree voltage of the stabilizer 12 and responsive to high frequency pulses, in serial connection with the resistor 18 in the circuit 19.

If the resistor 18 is connected parallel to the arc tube 13 without such micro-gap element 17, a constant current will be generated in said resistor 18 during the loadfree state of the stabilizer 12 and at the starting of the discharge lamp. In such case, for a resistance of 3 KΩ for example, said resistor 18 will consume a power $W=V^2/R=200^2/3\times10^3=13.3$ watts. A resistor of such high power is practically hardly acceptable for use in the outer bulb of the discharge lamp or even in an external casing.

The switching voltage of said micro-gap element 17 should be sufficiently high in order not to be activated by the secondary loadfree voltage of the stabilizer 12 and should not exceed the starting voltage of the discharge lamp. Said switching voltage of the micro-gap element is generally selected within a range of ca. 500 to 1500 v, since an excessively high switching voltage reduces the opportunity of waveform conversion in cooperation with the resistor 18 for the purposes of the present invention. Also the delay of discharge in the micro-gap element should not exceed 1 μsec. in order to be responsive to the pulse voltages involving high frequency components generated by the operation of the bimetal switch 15. Examination of various elements has revealed that a micro-gap element supplied by Mitsubishi Mining and Cement Co., Ltd. under a trade name DSA Surge Absorber is suitable for the purpose. It is sufficiently responsive to the high frequency components, as the insulation breakdown caused by the concentrated electric field ensures a delay of discharge less than 0.1 μsec. According to the present invention, the resistor 18 can be of a small dimension, for example of a nominal power of 1 W or less, since the micro-gap element having a switching voltage of 500 to 1500 V is not activated by the secondary loadfree voltage of the stabilizer. At the same time said resistor 18 should preferably be provided with a pulse voltage-proof in the order of 6 KV or higher. These requirements can be satisfied by a carbon film resistor of ½ to 1 W, which can be incorporated in the outer bulb of the discharge lamp because of the relatively small temperature dependence of resistance and the stability in a high-temperature condition in vacuum or in a gaseous atmosphere. The aforementioned micro-gap element can also be incorporated in the outer bulb of the discharge lamp.

Figure 9:
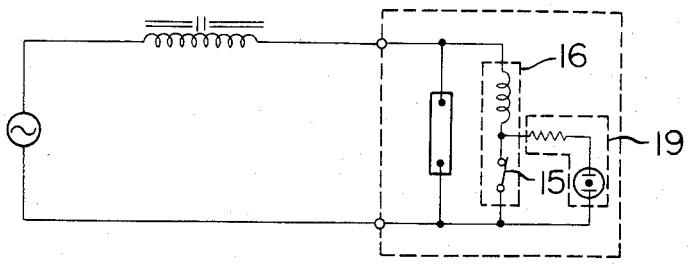
FIGS. 9 and 10 are circuit diagrams showing other embodiments of the starter of the present invention.
Figure 10:
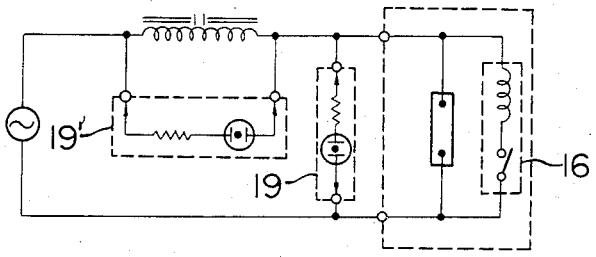

In the foregoing description, the resistor 14 in the starting circuit 16 and the resistor 18 in the circuit 19 are respectively exemplified by an incandescent filament and a carbon film resistor, but said resistors can be satisfactorily replaced for example by metal thick-layer resistors formed on a ceramic substrate. Also said pulse waveform conversion circuit 19 may be connected parallel to the bimetal switch 15 in the starting circuit 16 as shown in FIG. 9, or may be placed, eventually in combination with the starting circuit 16, outside the discharge lamp as shown in FIG. 10. Furthermore, if said circuits are placed outside the discharge lamp, at least one of said resistors 14 and 18 can be composed of a variable resistor in order to regulate the peak pulse voltage.

As another feature of the present invention, it is also possible to prevent the generation of excessively high pulse voltages by selecting, for the micro-gap element connected parallel to the arc tube, a starting voltage higher than mentioned in the foregoing.

Figure 11:
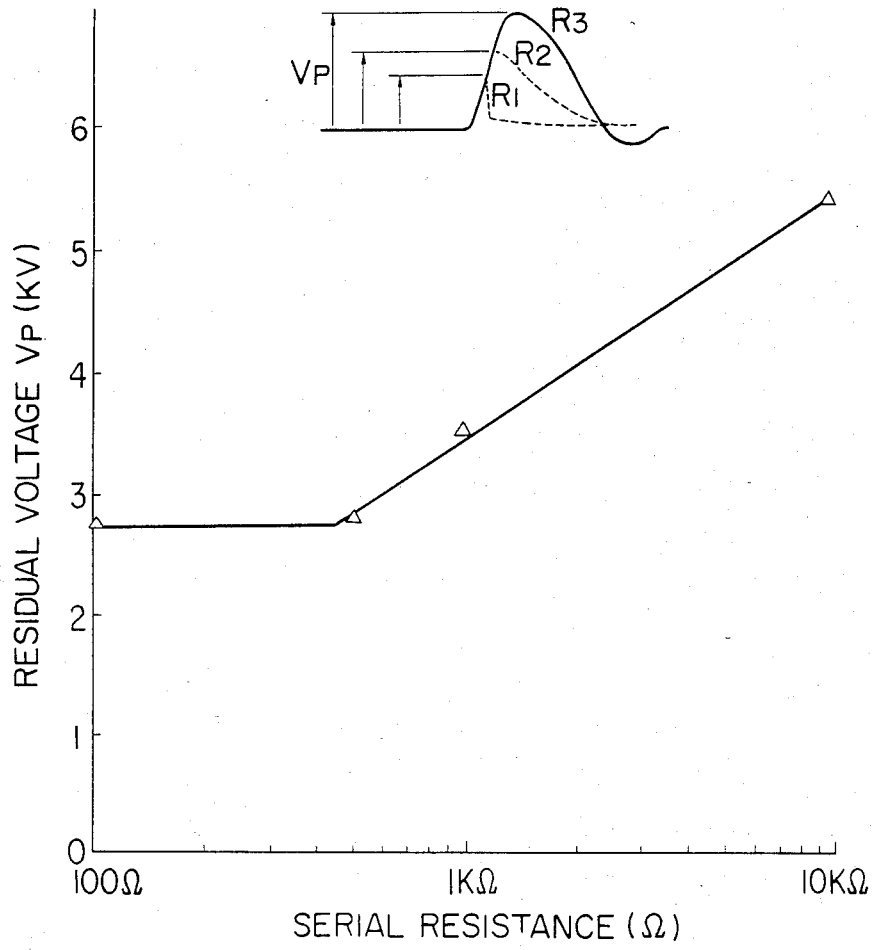
FIG. 11 is a chart showing the relationship between the peak residual voltage and the serial resistance.

The serial resistor 18 connected to the micro-gap element 17 is effective for preventing continued current in said element, but should not exceed a certain resistance in order to retain the surge voltage absorbing ability of the circuit. Experimentally the resistance R of said resistor 18 should be so selected that $V_0/\sqrt{R^2+(\omega L)^2}$ does not exceed 3, wherein $V_0$ is the secondary loadfree voltage of the stabilizer 12 and L is the equivalent serial inductance thereof, which is for example 122 mH for a discharge lamp of 400 W. Otherwise a continuous current is generated in the micro-gap element 17, thus reducing the service life thereof. On the other hand, the absorbing ability of the circuit for high voltage pulses decreases rapidly if said resistance exceeds 500 Ω and becomes almost nil at a resistance exceeding 5 kΩ, as shown in FIG. 11, wherein the ordinate indicates the residual voltage remaining across the serial circuit of the micro-gap element and the resistor. Such phenomenon observed at a higher resistance is presumably due to a fact that the discharge current after the activation of the micro-gap element at a predetermined voltage causes a significant voltage drop in the serial resistor, thus generating a voltage exceeding the starting voltage of the micro-gap element across the starting circuit to hinder the surge voltage absorbing effect. Because of these reasons the resistance of said serial resistor should be selected within a range not causing the continued current in the micro-gap element and not exceeding 5 kΩ for retaining the surge voltage absorbing ability.

Figure 12:
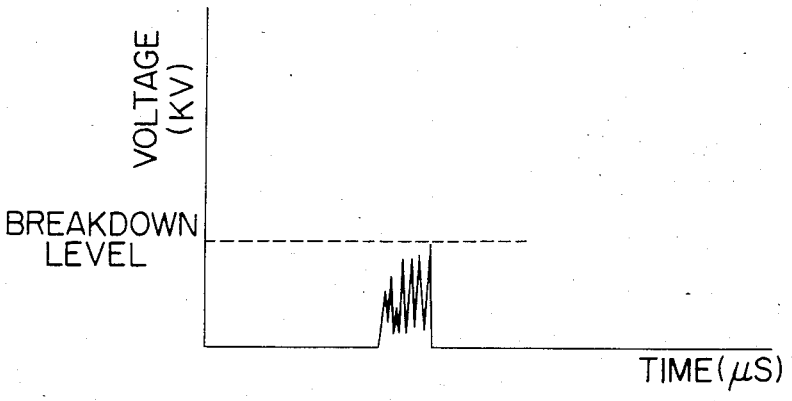
FIG. 12 is a waveform chart showing residual voltages of high-voltage pulses.

In the experiments conducted by the present inventors, with a serial resistor 18 of 50 Ω in the circuit shown in FIG. 5, the micro-gap element 17 experienced certain change in performance and started to show continued current after applications of high voltage pulses by 500 times. On the other hand, with a serial resistor 18 of 500 Ω, no such change could be observed even after applications of ca. 10,000 times. FIG. 12 shows the waveform of the residual high voltage pulses observed with a micro-gap element of a nominal starting voltage of 1.5 KV.

Figure 13:
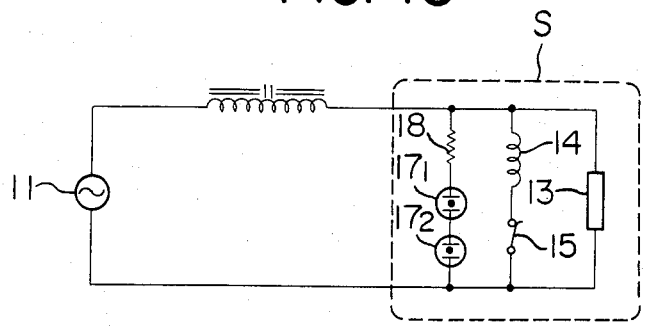
FIGS. 13, 14 and 15 are circuit diagrams showing other embodiments of the present invention.

FIG. 13 shows another embodiment of the present invention, in which two micro-gap elements $17_1$ and $17_2$ are serially connected to ensure the effect of preventing the continued current. Even in such case, the presence of a serial resistor 18 in the order of 100 Ω extends the service life of said micro-gap elements to further ensure the protection against the continued current.

Figure 14:
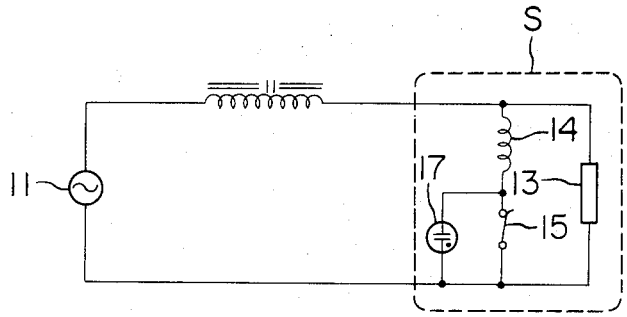
Figure 15:
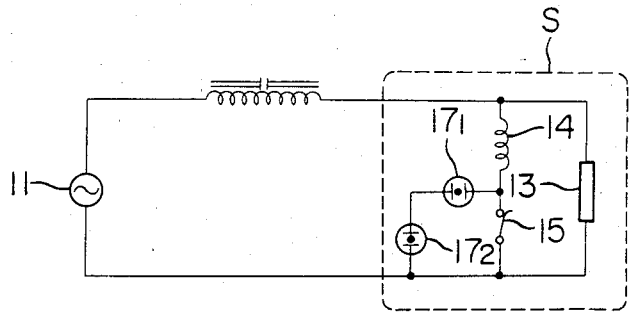

FIG. 14 shows still another embodiment of the present invention. The high-voltage pulse generating starter to be employed in the discharge lamp of the present invention can assume various forms, but can be most practically composed of a serial connection of a current-limiting resistor 14 and a thermal switch 15, wherein said resistor 14 is usually composed of an incandescent filament or a metal thick-film resistor formed on a ceramic substrate. In case of such starter structure, the micro-gap element 17 can be connected parallel to said thermal switch 15, or, stated otherwise, parallel to the arc tube 13 through said resistor 14, thereby omitting the serial resistor shown in FIG. 5 or 13. Also FIG. 15 shows still another embodiment employing two micro-gap elements $17^1$ and $17^2$and constituting a variation to the embodiment shown in FIG. 14.

In the foregoing embodiments, the interior of the outer bulb 7 surrounding the arc tube is preferably maintained in a substantially vacuum condition because of the reason to be explained later, and in this connection the present invention is most effectively applicable to the high pressure sodium lamp in which the outer bulb is generally maintained in vacuum state. In the micro-gap element of the structure shown in FIG. 6, the expiration of service life or functional failure ordinarily takes place by the leakage of the rare or inert gas filled in the container to the outside. With such gas leakage, the micro-gap element shows an elevated starting voltage, thus losing the function as a surge-absorbing element. However, in case such micro-gap element is incorporated in the outer bulb of the discharge lamp, the gas leaking from the micro-gap element fills the outer bulb. The gas leakage from the micro-gap element of a gas filling pressure ordinarily in the order of 500 Torr into the outer bulb maintained under high vacuum usually in the order of $10^{-7}$ Torr brings the internal pressure of said outer bulb up to $10^{-1}$ to 1 Torr depending on the dimension of said outer bulb, thus creating a state of quite easily inducing a discharge. Thus, even if pulse voltages are generated by the uncontrolled operation of the contacts of the thermal switch in such gaseous atmosphere, the discharge induced in said gaseous atmosphere dissipates the energy of said pulses, thus avoiding the high pulse voltages. In this manner the above-explained structure not only prevent the damage to the external circuit by the absorption of excessively high pulse voltages with the micro-gap element during the normal function state, but also provides additional safety even when the micro-gap element is broken, as the gas leaking from said element forms a discharge-inducing space in the outer bulb, absorbing the pulse energy generated by the starter through the discharge in said outer bulb.

In the foregoing embodiments, the present inventor made intentional leakage from a micro-gap element of a gas filling pressure of 500 Torr placed in a vacuum outer bulb of a high pressure sodium lamp and measured the pulse voltages generated in such condition. As the result, the pulse voltages showed a mean value of ca. 1.5 KV and did not exceed 2 KV.

As explained in the foregoing, the present invention is characterized by the use of the micro-gap element, which is smaller than varistor or other known elements and usable under a high temperature and is therefore extremely adapted for use in a high-efficiency, high-temperature discharge lamp such as the high pressure sodium lamp. Also the faster response of such micro-gap element in comparison with the conventional discharge gap allows effective absorption of rapid high-voltage pulses. In addition, the incorporation of such micro-gap element in the vacuum outer bulb of the discharge lamp provides an additional safety for preventing abnormally high pulse voltages even when said element is damaged. In this manner the present invention is capable of providing a practically useful discharge lamp.

The present invention is further characterized, in a high pressure discharge lamp having a starting circuit which consists of a serial connection of a resistor and a bimetal switch and is connected parallel to an arc tube of the discharge lamp, by a serial circuit which consists of a resistor and a micro-gap element capable of functioning at a voltage higher than the secondary loadfree voltage of said stabilizer and responsive to high frequency pulses and which is connected parallel to said arc tube, to the bimetal switch or to said stabilizer. The use of a serial circuit consisting of a resistor and a switching element such as a discharge gap and connected parallel to the bimetal switch is already known for example in a starter disclosed in the Japanese patent application Laid-Open No. 56-4198. Said known starter however does not aim at the conversion of pulse wave form but merely at the use of a pulse absorbing serial circuit consisting of a resistor and a discharge gap functioning at a voltage higher than the starting voltage of the discharge lamp, instead of a resistor serially connected with the bimetal switch in the starting circuit. Also said known starter is not provided with a resistor in the starting circuit. In such known starter the discharge lamp, after it is started by a pulse voltage generated by the function of the bimetal switch, may be extinguished again when said bimetal switch is closed again. Also since the bimetal switch interrupts a large current close to the secondary shortcircuit current of the stabilizer, there are generated extremely rapid pulse voltages of a significant energy, which can be scarecely controlled to an appropriate level even in the presence of a pulse voltage absorbing circuit. In this manner the technology of the present invention provides advantages not achievable in the known technologies and is therefore clearly distinguishable from the known technologies.

The advantages of the present invention are summarized in the following.

As already explained in the foregoing, the pulse voltage generated by the starter of the present invention has a broadened pulse width, which allows to reduce the maximum pulse voltage without losing the ability for starting the discharge lamp. Thus lowered maximum pulse the related contributes to the safety of the stabilizer and related circuitry. Also said pulse voltage, being stable in waveform and containing little sawtooth pulses, is capable of efficiently and stably starting the discharge lamp. Furthermore, the starting circuit and the pulse voltage controlling circuit can be easily incorporated together with the arc tube in the outer bulb of the discharge since the former is a simple two-terminal circuit composed of a resistor and a bimetal switch while the latter is also a simple two-terminal circuit composed of a resistor and a micro-gap element, and since temperature-durable components can be selected in said circuits. Furthermore the freedom in the designing of the starter is increased since the pulse voltage level can be arbitrarily regulated by the suitable selection of the resistances in the starting circuit and in the pulse voltage controlling circuit.

Furthermore the starter of the present invention tends to show an increased number of functions of the bimetal switch for an unidentified reason, so that the starting of the discharge lamp is facilitated by such increased number of pulse voltages.

As detailedly explained in the foregoing, the starter of the present invention for a high pressure discharge lamp is industrially useful because of various advantages over the conventional starters.

We claim:

1. A discharge lamp device comprising a discharge lamp, an inductive stabilier connected in series with discharge lamp, starting circuit means, including a resistor and a bimetal switch in series connected to said discharge lamp for providing a starting voltage waveform including repetitive high voltage pulses, and pulse wave conversion means having a micro-gap element comprising an insulating member of high relative dielectric constant, a conductive layer divided into separate zone formed on said insulating member and electrodes respectively connected to separate ones of said zones, and air-tight container enclosing the micro-gap element and filled with a rare or inert gas, and a resistor connected in series with the micro-gap element, the micro-gap element being constructed to be rendered conductive at a voltage lower than the starting voltage of the discharge lamp but higher than the secondary load-free voltage of the stabilizer, and the resistor having a value such that said pulse waveform conversion means converts said starting voltage waveform from an oscillatory waveform to a damped waveform having wider half value width.

2. A discharge lamp device according to claim 1, wherein said resistor of said starting circuit means comprises an incandescent filament and wherein said resistor of said pulse waveform conversion means comprises a carbon film resistor.

3. A discharge lamp device according to claim 1, wherein said resistors are thick-film metal resistors.

4. A discharge lamp device according to claim 1, wherein at least one of said resistors is a variable resistor.

5. A discharge lamp device according to claim 1, wherein said discharge lamp is a high pressure sodium lamp.

6. A discharge lamp device according to claim 1, wherein said starting circuit means is connected in parallel with said discharge lamp.

7. A discharge lamp device according to claim 1, wherein said pulse waveform conversion means is connected across said starting circuit means.

8. A discharge lamp device according to claim 1, wherein said pulse waveform conversion means is connected across said bimetal switch.

9. A discharge lamp device according to claim 1, wherein said pusle waveform conversion means is connected across said stabilizer.

10. A discharge lamp device according to claim 1, wherein the resistance of the resistor of said pulse waveform conversion means has a value not exceeding 5,000 ohms.

* * * * *